US008428501B2

(12) United States Patent
Shinshi et al.

(10) Patent No.: US 8,428,501 B2
(45) Date of Patent: Apr. 23, 2013

(54) FIXING DEVICE AND IMAGE FORMING APPARATUS INCORPORATING SAME

(75) Inventors: Akira Shinshi, Machida (JP); Yoshiki Yamaguchi, Sagamihara (JP); Kenichi Hasegawa, Atsugi (JP); Masaaki Yoshikawa, Tokyo (JP); Hiroshi Yoshinaga, Ichikawa (JP); Kenji Ishii, Kawasaki (JP); Tetsuo Tokuda, Kawasaki (JP); Ippei Fujimoto, Ebina (JP); Yutaka Ikebuchi, Chigasaki (JP); Shuntaroh Tamaki, Kawasaki (JP); Toshihiko Shimokawa, Zama (JP); Naoki Iwaya, Choufu (JP)

(73) Assignee: Ricoh Company, Ltd., Tokyo (JP)

( * ) Notice: Subject to any disclaimer, the term of this patent is extended or adjusted under 35 U.S.C. 154(b) by 303 days.

(21) Appl. No.: 12/874,734

(22) Filed: Sep. 2, 2010

(65) Prior Publication Data

US 2011/0052282 A1 Mar. 3, 2011

(30) Foreign Application Priority Data

Sep. 3, 2009 (JP) ..... 2009-203496
May 7, 2010 (JP) ..... 2010-107361

(51) Int. Cl.
*G03G 15/20* (2006.01)

(52) U.S. Cl.
USPC ..... 399/329

(58) Field of Classification Search ..... 399/320, 399/328, 329
See application file for complete search history.

(56) References Cited

U.S. PATENT DOCUMENTS

| | | | | |
|---|---|---|---|---|
| 5,280,155 | A * | 1/1994 | Ohtsuka et al. | 219/216 |
| 6,498,911 | B2 * | 12/2002 | Hiroki et al. | 399/329 X |
| 7,457,576 | B2 * | 11/2008 | Takada et al. | 399/329 |
| 7,702,271 | B2 | 4/2010 | Yamada et al. | |
| 2006/0083567 | A1 | 4/2006 | Ito et al. | |
| 2007/0292175 | A1 | 12/2007 | Shinshi | |

(Continued)

FOREIGN PATENT DOCUMENTS

| | | |
|---|---|---|
| JP | 10-213984 | 8/1998 |
| JP | 2884714 | 2/1999 |

(Continued)

OTHER PUBLICATIONS

Extended European Search Report issued Sep. 6, 2011, in Patent Application No. 10174786.3.

(Continued)

*Primary Examiner* — Sandra Brase
(74) *Attorney, Agent, or Firm* — Oblon, Spivak, McClelland, Maier & Neustadt, L.L.P.

(57) ABSTRACT

In a fixing device, a nip formation member is provided inside a loop formed by a fixing member rotating in a predetermined direction of rotation. A pressing member is pressed against the nip formation member via the fixing member to form a nip between the fixing member and the pressing member through which a recording medium bearing a toner image passes. The fixing member and the pressing member rotate and convey the recording medium bearing the toner image through the nip. The heat conduction member faces an inner circumferential surface of the fixing member to guide the fixing member sliding over the heat conduction member and to transmit heat to the fixing member. The heat conduction member includes a plurality of convex portions provided on an outer circumferential surface of the heat conduction member and contacting the inner circumferential surface of the fixing member.

42 Claims, 8 Drawing Sheets

U.S. PATENT DOCUMENTS

| | | | | |
|---|---|---|---|---|
| 2008/0112739 | A1 | 5/2008 | Shinshi | |
| 2008/0175633 | A1 | 7/2008 | Shinshi | |
| 2008/0219730 | A1 | 9/2008 | Shinshi | |
| 2008/0298862 | A1 | 12/2008 | Shinshi | |
| 2009/0016790 | A1* | 1/2009 | Funabiki | 399/329 |
| 2009/0148204 | A1 | 6/2009 | Yoshinaga et al. | |
| 2009/0169232 | A1 | 7/2009 | Kunii et al. | |
| 2009/0245865 | A1 | 10/2009 | Shinshi et al. | |
| 2009/0311016 | A1 | 12/2009 | Shinshi | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |

FOREIGN PATENT DOCUMENTS

| | | |
|---|---|---|
| JP | 3298354 | 4/2002 |
| JP | 2002-299007 | * 10/2002 |
| JP | 2006-47769 | 2/2006 |
| JP | 2006-047769 | * 2/2006 |
| JP | 2009-3410 | 1/2009 |

OTHER PUBLICATIONS

U.S. Appl. No. 12/780,309, filed May 14, 2010, Kenichi Hasegawa et al.

U.S. Appl. No. 12/662,991, filed May 14, 2010.

U.S. Appl. No. 12/841,593, filed Jul. 22, 2010, Masaaki Yoshikawa et al.

U.S. Appl. No. 12/828,612, filed Jul. 1, 2010, Masaharu Furuya et al.

U.S. Appl. No. 12/823,770, filed Jun. 25, 2010, Kenichi Hasegawa.

* cited by examiner

FIXING DEVICE AND IMAGE FORMING APPARATUS INCORPORATING SAME

CROSS-REFERENCE TO RELATED APPLICATIONS

The present application is based on and claims priority to Japanese Patent Application Nos. 2009-203496, filed on Sep. 3, 2009, and 2010-107361, filed on May 7, 2010, in the Japan Patent Office, each of which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus including the fixing device.

2. Description of the Related Art

Related-art image foaming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a fixing belt or a fixing film to apply heat to the recording medium bearing the toner image. FIG. 1 is a sectional view of a fixing device 20R1 including a fixing belt 204. The fixing belt 204 is looped around a heating roller 202 and a fixing roller 203. A pressing roller 205 presses against the fixing roller 203 via the fixing belt 204 to form a fixing nip N between the pressing roller 205 and the fixing belt 204. The fixing belt 204 is heated by a heater 201 provided inside the heating roller 202. As a recording medium P bearing a toner image passes between the fixing roller 203 and the pressing roller 205 on the fixing belt 204, the fixing belt 204 and the pressing roller 205 apply heat and pressure to the recording medium P bearing the toner image to fix the toner image on the recording medium P.

One problem with such an arrangement, however, is that the heating roller 202 has a relatively large heat capacity, resulting in a longer warm-up time of the fixing device 20R1. To address this problem, instead of the fixing belt 204 the fixing device may include a fixing film having a relatively small heat capacity. FIG. 2 is a sectional view of a fixing device 20R2 including a fixing film 213. A pressing roller 212 presses against a ceramic heater 211 provided inside the fixing film 213 via the fixing film 213 to form a fixing nip N between the pressing roller 212 and the fixing film 213. As a recording medium bearing a toner image passes between the pressing roller 212 and the fixing film 213, the fixing film 213 heated by the ceramic heater 211 and the pressing roller 212 apply heat and pressure to the recording medium bearing the toner image to fix the toner image on the recording medium.

However, the fixing film 213 has a drawback in that, over time, friction between the ceramic heater 211 and the fixing film 213 sliding over the ceramic heater 211 increases, resulting eventually in unstable movement of the fixing film 213 and increasing the required driving torque of the fixing device 20R2. Further, the rotating fixing film 213 is heated by the ceramic heater 211 only at the fixing nip N, and therefore the fixing film 213 is at its lowest temperature just before entering the fixing nip N in a direction of rotation of the fixing film 213. Accordingly, when the fixing film 213 is rotated at high speed, the fixing film 213 passing through the fixing nip N may not have a proper fixing temperature, resulting in faulty image fixing.

To address the above-described problems, the fixing device may include a pipe-shaped metal member provided inside the fixing belt, with a slight gap provided between the fixing belt and the pipe-shaped metal member. The pipe-shaped metal member transmits heat received from a heater provided inside the pipe-shaped metal member to the fixing belt, to maintain the fixing belt at the proper temperature.

However, the same friction-based problem remains. That is, when the fixing belt rotates, the fixing belt slides over the stationary, pipe-shaped metal member, and frictional resistance generated between the fixing belt and the pipe-shaped metal member applies a greater load to the fixing belt. Accordingly, a greater driving force is required to rotate the fixing belt. Consequently, the fixing device may require a driving motor capable of generating a greater driving force to rotate the fixing belt, resulting in a larger fixing device and increased power consumption.

Moreover, when the fixing belt is configured to rotate in accordance with rotation of the pressing roller, the greater load applied to the rotating fixing belt exerts a substantial shearing force on the surface of the pressing roller continuously, resulting in excessive wear of the pressing roller over time and slippage of the fixing belt.

BRIEF SUMMARY OF THE INVENTION

This specification describes below an improved fixing device. In one exemplary embodiment of the present invention, the fixing device for fixing a toner image on a recording medium includes a flexible endless fixing member, a nip formation member, a pressing member, and a non-rotating heat conduction member. The fixing member rotates in a predetermined direction of rotation, and is formed into a loop. The nip formation member is provided inside the loop formed by the fixing member. The pressing member is disposed opposite the nip formation member and outside the loop formed by the fixing member, and is pressed against the nip formation member via the fixing member to form a nip between the fixing member and the pressing member through which the recording medium bearing the toner image passes. The fixing member and the pressing member rotate and convey the recording medium bearing the toner image through the nip. The heat conduction member is disposed within the loop formed by the fixing member and faces an inner circumferential surface of the fixing member to guide the fixing member sliding over the heat conduction member as the fixing member rotates and to transmit heat to the fixing member. The heat conduction member includes a plurality of convex portions provided on an outer circumferential surface of the heat conduction member and contacting the inner circumferential surface of the fixing member.

This specification further describes below an image forming apparatus. In one exemplary embodiment, the image forming apparatus includes an image forming device that forms a toner image on a recording medium and the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
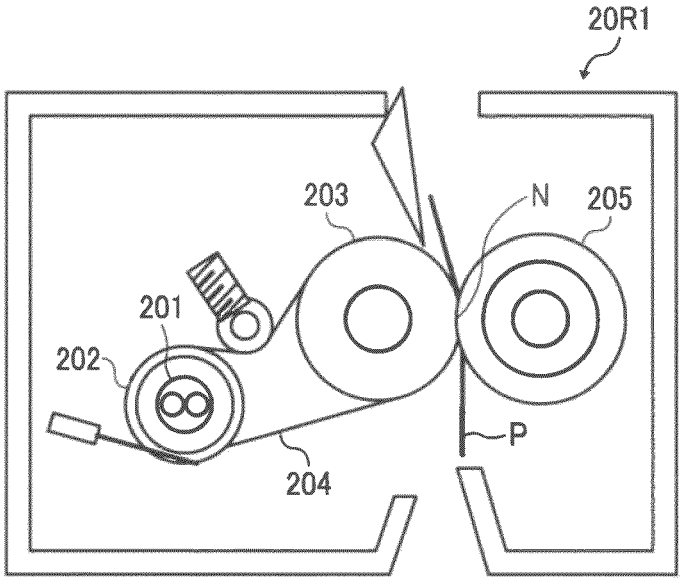
FIG. 1 RELATED ART
FIG. 1 is a sectional view of a related-art fixing device.
Figure 2:
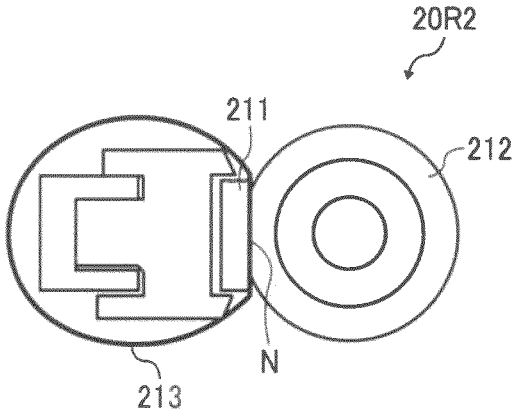
FIG. 2 RELATED ART
FIG. 2 is a sectional view of another related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 3:
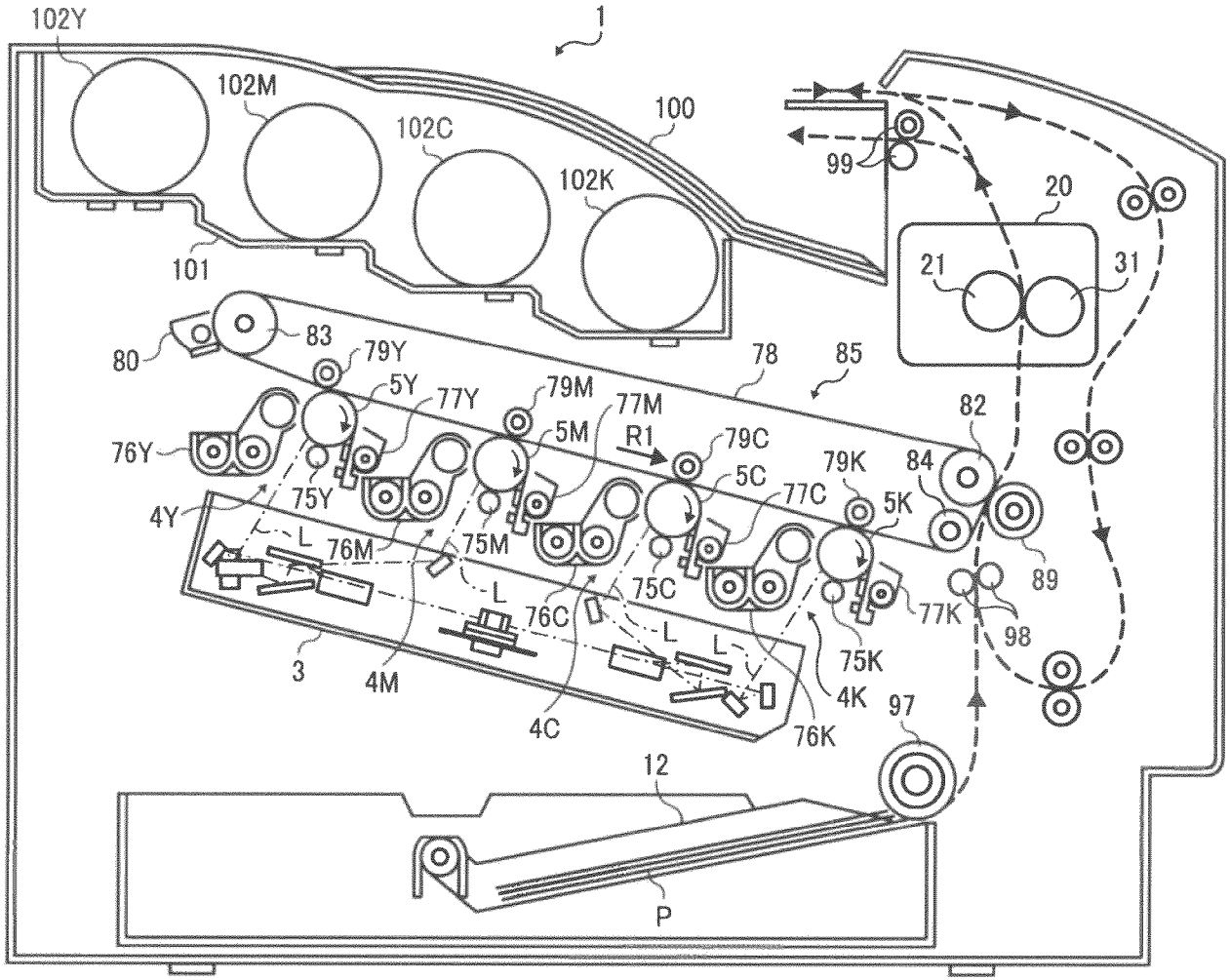
FIG. 3 is a schematic view of an image forming apparatus according to an exemplary embodiment of the present invention.

Referring now to the drawings, wherein like reference numerals designate identical or corresponding parts throughout the several views, in particular to FIG. 3, an image forming apparatus 1 according to an exemplary embodiment of the present invention is explained.

FIG. 3 is a schematic view of the image forming apparatus 1. As illustrated in FIG. 3, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium by electrophotography or electrostatic recording.

As illustrated in FIG. 3, the image foaming apparatus 1 includes an exposure device 3, image forming devices 4Y, 4M, 4C, and 4K, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a first transfer process, and a cleaning process are performed on the rotating photoconductive drums 5Y, 5M, 5C, and 5K to form yellow, magenta, cyan, and black toner images on the photoconductive drums 5Y, 5M, 5C, and 5K, respectively.

The following describes the image forming processes performed on the photoconductive drums 5Y, 5M, 5C, and 5K.

A driving motor drives and rotates the photoconductive drums 5Y, 5M, 5C, and 5K clockwise in FIG. 3. In the charging process, the chargers 75Y, 75M, 75C, and 75K uniformly charge surfaces of the photoconductive drums 5Y, 5M, 5C, and 5K, respectively.

In the exposure process, the exposure device 3 emits laser beams L onto the charged surfaces of the photoconductive drums 5Y, 5M, 5C, and 5K to irradiate and expose the charged surfaces of the photoconductive drums 5Y, 5M, 5C, and 5K, respectively, so as to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images, respectively.

In the first transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78. Thus, a color toner image is formed on the intermediate transfer belt 78.

After the transfer of the yellow, magenta, cyan, and black toner images, the surfaces of the photoconductive drums 5Y, 5M, 5C, and 5K from which the yellow, magenta, cyan, and black toner images are transferred reach positions at which the cleaners 77Y, 77M, 77C, and 77K are disposed opposite the photoconductive drums 5Y, 5M, 5C, and 5K, respectively. In the cleaning process, cleaning blades included in the cleaners 77Y, 77M, 77C, and 77K mechanically collect residual toner remaining on the surfaces of the photoconductive drums 5Y, 5M, 5C, and 5K from the photoconductive drums 5Y, 5M, 5C, and 5K, respectively. Thereafter, dischargers remove residual potential on the surfaces of the photoconductive drums 5Y, 5M, 5C, and 5K, respectively, thus completing a single sequence of image forming processes performed on the photoconductive drums 5Y, 5M, 5C, and 5K.

The following describes a series of transfer processes performed on the intermediate transfer belt 78.

The intermediate transfer unit 85 includes the endless, intermediate transfer belt 78, the four first transfer bias rollers 79Y, 79M, 79C, and 79K, the second transfer backup roller 82, the cleaning backup roller 83, the tension roller 84, and the intermediate transfer cleaner 80.

The intermediate transfer belt 78 is supported by and stretched over the second transfer backup roller 82, the cleaning backup roller 83, and the tension roller 84. The second transfer backup roller 82 drives and rotates the intermediate transfer belt 78 in a direction R1.

The first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively.

As the intermediate transfer belt 78 moves in the direction R1 and passes through the first transfer nips formed between the intermediate transfer belt 78 and the photoconductive drums 5Y, 5M, 5C, and 5K successively, the yellow, magenta, cyan, and black toner images formed on the photoconductive drums 5Y, 5M, 5C, and 5K, respectively, are transferred and superimposed onto the intermediate transfer belt 78. Thus, a color toner image is formed on the intermediate transfer belt 78.

The paper tray 12 is provided in a lower portion of the image forming apparatus 1, and loads a plurality of recording media P (e.g., transfer sheets). The feed roller 97 rotates counterclockwise in FIG. 3 to feed an uppermost recording medium P of the plurality of recording media P loaded on the paper tray 12 toward the registration roller pair 98.

The registration roller pair 98, which stops rotating temporarily, stops the uppermost recording medium P fed by the feed roller 97. For example, a roller nip of the registration roller pair 98 contacts and stops a leading edge of the recording medium P temporarily. The registration roller pair 98 resumes rotating to feed the recording medium P to a second transfer nip formed between the second transfer roller 89 and the intermediate transfer belt 78, as the color toner image formed on the intermediate transfer belt 78 reaches the second transfer nip.

After the first transfer process, an outer circumferential surface of the intermediate transfer belt 78 bearing the color toner image reaches a position at which the second transfer roller 89 is disposed opposite the intermediate transfer belt 78. At this position, the second transfer roller 89 and the second transfer backup roller 82 sandwich the intermediate transfer belt 78 to form the second transfer nip between the second transfer roller 89 and the intermediate transfer belt 78. At the second transfer nip, the second transfer roller 89 transfers the color toner image formed on the intermediate transfer belt 78 onto the recording medium P fed by the registration roller pair 98 in a second transfer process. After the second transfer process, when the outer circumferential surface of the intermediate transfer belt 78 reaches a position at which the intermediate transfer cleaner 80 is disposed opposite the intermediate transfer belt 78, the intermediate transfer cleaner 80 collects residual toner from the intermediate transfer belt 78, thus completing a single sequence of transfer processes performed on the intermediate transfer belt 78.

The recording medium P bearing the color toner image is sent to the fixing device 20. In the fixing device 20, the fixing belt 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

Figure 4:
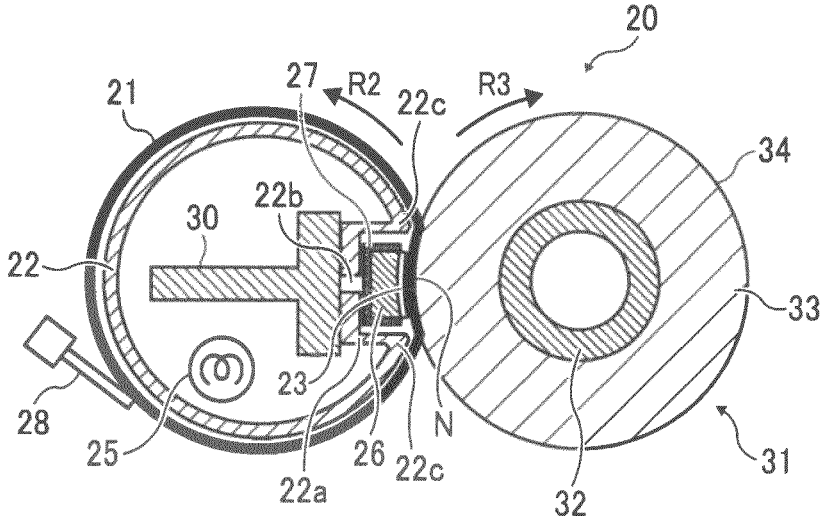
FIG. 4 is a sectional view of a fixing device included in the image forming apparatus shown in FIG. 3.

FIG. 4 is a sectional view of the fixing device 20. As illustrated in FIG. 4, the fixing device 20 further includes a heat conduction member 22, a lubrication sheet 23, a halogen heater 25, a nip formation member 26, a heat insulator 27, a thermistor 28, and a support member 30. The heat conduction member 22 includes a concave portion 22*a*, an opening 22*b*, and corner portions 22*c*. The pressing roller 31 includes a metal core 32, an elastic layer 33, and a release layer 34.

As illustrated in FIG. 4, in the fixing device 20, the fixing belt 21 (e.g., a flexible endless belt) serves as a fixing member. The substantially pipe-shaped or cylindrical heat conduction member 22 is provided inside a loop formed by the fixing belt 21. The halogen heater 25 serves as a heater that heats the heat conduction member 22. The thermistor 28 serves as a temperature sensor that contacts an outer circumferential surface of the fixing belt 21 and detects a temperature of the outer circumferential surface of the fixing belt 21. The pressing roller 31 serves as a pressing member that contacts the fixing belt 21 to form a fixing nip N between the pressing roller 31 and the fixing belt 21.

The concave portion 22*a* of the heat conduction member 22 faces the fixing nip N. The nip formation member 26, the lubrication sheet 23, and the heat insulator 27 are provided in the concave portion 22*a*. The nip formation member 26 is pressed against the pressing roller 31 via the fixing belt 21 to form the fixing nip N between the pressing roller 31 and the fixing belt 21. The mesh lubrication sheet 23 is provided between the fixing belt 21 and the nip formation member 26. The heat insulator 27 is provided between a bottom of the concave portion 22*a* of the heat conduction member 22 and the nip formation member 26.

The nip formation member 26 includes an elastic material such as silicon rubber and/or fluorocarbon rubber. An inner circumferential surface of the fixing belt 21 slides over the nip formation member 26 indirectly via the lubrication sheet 23. Alternatively, the inner circumferential surface of the fixing belt 21 may slide over the nip formation member 26 directly.

According to this exemplary embodiment, the heat conduction member 22 includes the concave portion 22*a*. Alternatively, the heat conduction member 22 may include a portion that has a planar shape or other shape to face the fixing nip N. However, the concave portion 22*a* can direct a leading edge of a recording medium P exiting the fixing nip N toward the pressing roller 31, thus facilitating separation of the recording medium P from the fixing belt 21 and suppressing jamming of the recording medium P.

The pressing roller 31 is constructed of the metal core 32, that is, a hollow metal roller; the elastic layer 33 (e.g., a silicon rubber layer) surrounding the metal core 32; and the release layer 34 surrounding the elastic layer 33, serving as an outer circumferential layer that facilitates separation of the recording medium P from the pressing roller 31. The release layer 34 may be a resin layer including perfluoroalkylvinylether copolymer (PFA) and/or polytetrafluoroethylene (PTFE).

A driver (e.g., a motor) provided in the image forming apparatus 1 depicted in FIG. 3 transmits a driving force to the pressing roller 31 via a gear train to drive and rotate the pressing roller 31. A biasing member, such as a spring, presses the pressing roller 31 against the fixing belt 21. In other words, the spring presses the elastic layer 33 of the pressing roller 31 against the nip formation member 26, deforming the elastic layer 33 so as to form the fixing nip N with a predetermined nip length.

It is to be noted that, alternatively, the pressing roller 31 may be a solid roller. However, a hollow roller, with its smaller heat capacity, is preferably used as the pressing roller 31. Further, a heat source (e.g., a halogen heater) may be provided inside the pressing roller 31.

The elastic layer 33 of the pressing roller 31 may include solid rubber. Alternatively, when a heat source such as a heater is not provided inside the pressing roller 31, the elastic layer 33 may preferably include sponge rubber to improve heat insulation to suppress heat transmission from the fixing belt 21 to the pressing roller 31.

The fixing belt 21 may be a metal belt including nickel and/or stainless steel, or an endless belt or an endless film including a resin material such as polyimide. The fixing belt 21 may include a release layer as a surface layer, that is, a resin layer including PFA and/or PTFE, to prevent the toner image on the recording medium P from adhering to the fixing belt 21, thus facilitating separation of the recording medium P bearing the toner image from the fixing belt 21.

The fixing belt 21 may further include a base layer, and an elastic layer (e.g., a silicon rubber layer) provided between the base layer and the release layer. If the elastic layer is not provided, the fixing belt 21 has a smaller heat capacity, improving fixing property. However, the fixing belt 21 without the elastic layer may crush an unfixed toner image on the recording medium P, generating slight surface asperities in the fixing belt 21 that in turn are transferred to a solid toner image on the recording medium P. As a result, a rough toner image having the appearance of an orange peel may be formed on the recording medium P. To address this problem, the elastic layer needs to have a thickness of not less than 100 μm. Such a thick elastic layer deforms to absorb slight surface asperities of the fixing belt 21, suppressing the orange-peel effect.

The hollow heat conduction member 22 may be a metal pipe including aluminum, iron, and/or stainless steel. According to this exemplary embodiment, the heat conduction member 22 has a circular shape in cross-section, with a diameter about 1 mm smaller than the diameter of the fixing belt 21 when the fixing belt 21 is formed into a loop around the hollow heat conduction member 22. Alternatively, the heat conduction member 22 may have a square shape or some other shape in cross-section.

The concave portion 22*a* of the heat conduction member 22 houses the nip formation member 26 and the heat insulator 27. The support member 30 is provided inside the heat conduction member 22, and holds and supports the nip formation member 26 and the heat insulator 27. In order to prevent radiation heat generated by the halogen heater 25 from heating the support member 30, a surface of the support member 30 may be insulated or mirror-finished to suppress energy absorption.

According to this exemplary embodiment, the halogen heater 25 is used as a heat source that heats the heat conduction member 22. Alternatively, an induction heater (IH), a resistance heat generator, or a carbon heater may be used as a heat source that heats the heat conduction member 22.

Further, according to this exemplary embodiment, the halogen heater 25 heats the fixing belt 21 indirectly via the heat conduction member 22. Alternatively, the fixing belt 21 may be heated directly.

The fixing belt 21 rotates in accordance with rotation of the pressing roller 31. Specifically, the driver described above rotates the pressing roller 31, and a driving force is transmitted from the pressing roller 31 to the fixing belt 21 at the fixing nip N to rotate the fixing belt 21.

At the fixing nip N, the fixing belt 21 is sandwiched between the nip formation member 26 and the pressing roller 31, and is rotated by the rotating pressing roller 31. By contrast, at a position other than the fixing nip N, the fixing belt 21 is guided by the heat conduction member 22 in such a manner that the fixing belt 21 does not separate from the heat conduction member 22 by more than a predetermined distance.

A lubricant such as silicon oil or fluorine grease is applied between the fixing belt 21 and the heat conduction member 22. The heat conduction member 22 has a surface roughness not smaller than particle size of the lubricant to better retain the lubricant.

A surface of the heat conduction member 22 may be roughened by various methods, such as a method for physically roughening (e.g., sandblasting), a method for chemically roughening (e.g., etching), or a method for applying a coating material including small beads.

Figure 5:
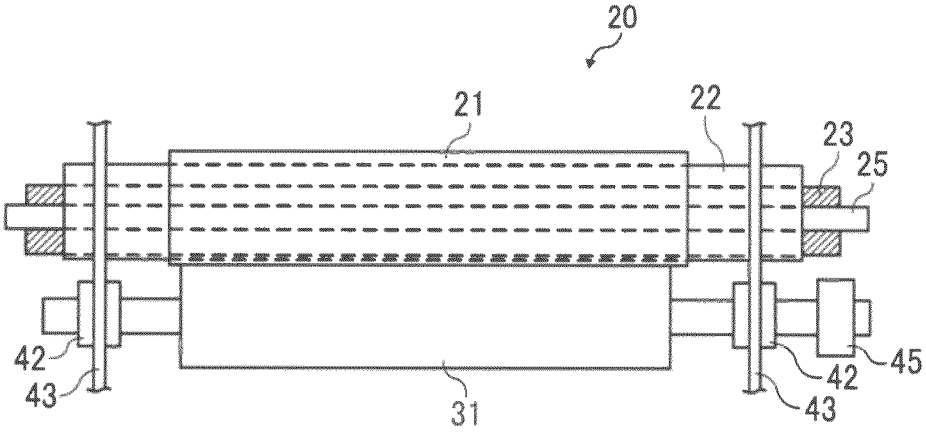
FIG. 5 is a plan view of the fixing device shown in FIG. 4.

FIG. 5 is a plan view of the fixing device 20. As illustrated in FIG. 5, the fixing device 20 further includes bearings 42, side plates 43, and a gear 45.

As illustrated in FIG. 5, the components of the fixing device 20 depicted in FIG. 4 are attached to or supported by the side plates 43 of the fixing device 20. The side plates 43 include a material having great rigidity to support and position the components of the fixing device 20.

As illustrated in FIG. 4, the pressing roller 31 has a loop diameter of 30 mm, and includes the hollow metal core 32 and the elastic layer 33 provided on the metal core 32. The elastic layer 33 includes silicon rubber foam, silicon rubber, and/or fluorocarbon rubber. According to this exemplary embodiment, the thin release layer 34 including PFA and/or PTFE is provided on the elastic layer 33 as a surface layer. Alternatively, the release layer 34 may not be provided.

The pressing roller 31 presses against the fixing belt 21 to form the desired fixing nip N between the pressing roller 31 and the fixing belt 21. The gear 45 is mounted on the pressing roller 31, and engages a driving gear of a driving mechanism so that the driving mechanism drives and rotates the pressing roller 31 clockwise in a rotation direction R3 depicted in FIG. 4.

Both ends of the pressing roller 31 in a width direction of the pressing roller 31, that is, in an axial direction of the pressing roller 31, are rotatively supported by the side plates 43 via the bearings 42, respectively. A heat source (e.g., a halogen heater) may be provided inside the pressing roller 31, but is not necessary.

When the elastic layer 33 of the pressing roller 31 includes a sponge material such as silicon rubber foam, the pressing roller 31 applies decreased pressure to the fixing belt 21 at the fixing nip N, reducing bending of the heat conduction member 22, improving insulation of the pressing roller 31 to suppress heat transmission from the fixing belt 21 to the pressing roller 31, and therefore improving heating efficiency for heating the fixing belt 21.

According to this exemplary embodiment, the loop diameter of the fixing belt 21 is substantially equivalent to the loop diameter of the pressing roller 31. Alternatively, the loop diameter of the fixing belt 21 may be smaller than the loop diameter of the pressing roller 31. Accordingly, a curvature of the fixing belt 21 is smaller than a curvature of the pressing roller 31 at the fixing nip N, facilitating separation of the recording medium P discharged from the fixing nip N from the fixing belt 21.

Figure 6:
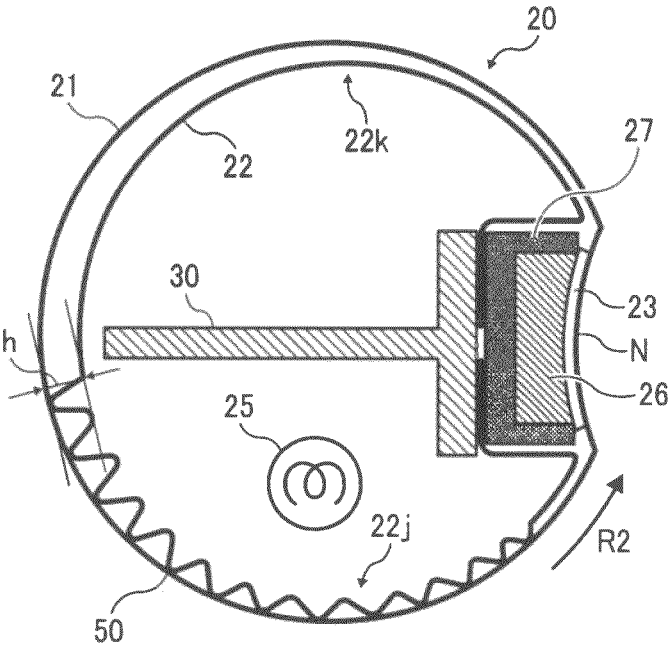
FIG. 6 is an enlarged sectional view of the fixing device shown in FIG. 4.

FIG. 6 is an enlarged sectional view of the fixing device 20. As illustrated in FIG. 6, the heat conduction member 22 further includes an upstream portion 22*j*, a downstream portion 22*k*, and convex portions 50.

In the fixing device 20 in cross-section along the diameter of the heat conduction member 22 as illustrated in FIG. 6, a plurality of convex portions 50 is provided in the upstream portion 22*j*, that is, a lower portion in FIG. 6, of the heat conduction member 22 in the rotation direction R2 of the fixing belt 21, that is, in a direction in which the rotating fixing belt 21 is tensioned by the rotating pressing roller 31. Each of the plurality of convex portions 50, that is, each protrusion of the heat conduction member 22, has a height h defined as a height from a bottom of the convex portion 50 to a top, that is, a summit, of the convex portion 50. The height h of the plurality of convex portions 50 decreases as the convex portions 50 approach the fixing nip N in the rotation direction R2 of the fixing belt 21. Specifically, the convex portion 50 disposed farthest from the fixing nip N has a greatest height and the convex portion 50 disposed closest to the fixing nip N has a smallest height. According to this exemplary embodiment, the greatest height h of the convex portion 50 is about 0.8 mm. The closer the convex portion 50 to the fixing nip N, the smaller the height h of the convex portion 50.

Figure 7:
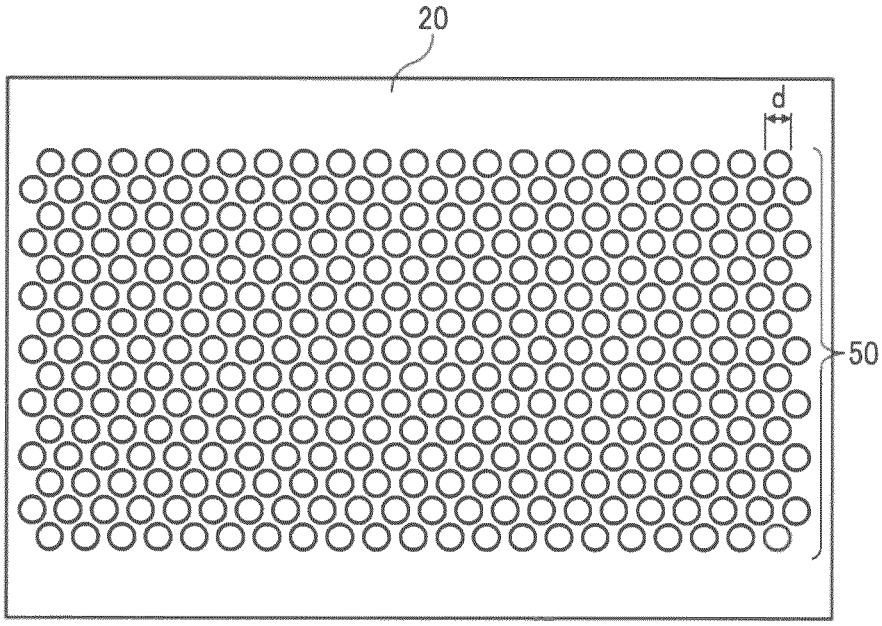
FIG. 7 is a plan view of convex portions included in the fixing device shown in FIG. 6.

FIG. 7 is a plan view of the convex portions 50. A diameter d of each convex portion 50 is defined as a diameter of the convex portion 50 seen from the top of the convex portion 50. According to this exemplary embodiment, the diameter d is in a range of from about 0.5 mm to about 2.0 mm. The plurality of convex portions 50 is also arranged in an axial direction of the heat conduction member 22. Specifically, the convex portions 50 are arranged alternately both in the axial direction and a circumferential direction of the heat conduction member 22, in such a manner that the convex portions 50 are not aligned in line in the axial direction and the circumferential direction of the heat conduction member 22 but are slightly offset.

As for the method of manufacture of the pipe-shaped metal heat conduction member 22 having the convex portions 50, sheet metal may be pressed to form the convex portions 50 and an overall shape of the heat conduction member 22, with the sheet metal then bent into the pipe shape described above. The height h of the convex portions 50 may be adjusted properly with a mold used for pressing.

The following describes the structure of the fixing device 20 and experiments conducted using the fixing device 20.

Specifically, experiments were performed to examine how the fixing device 20, in which the inner circumferential surface of the fixing belt 21 slides over the heated, pipe-shaped metal heat conduction member 22 to transmit heat from the heat conduction member 22 to the fixing belt 21, can increase the temperature of the fixing belt 21 effectively, shorten a warm-up time, and decrease a driving force of the fixing belt 21.

In one comparative fixing device in which a slight gap is provided between a fixing belt and a pipe-shaped metal heat conduction member having a circular shape, the gap is narrowed toward a fixing nip like a wedge. The fixing belt slides over the heat conduction member with a greatest frictional resistance at the fixing nip. However, while the fixing belt rotates, an upstream portion of the fixing belt, that is, upstream from the fixing nip in a rotation direction of the fixing belt, and sliding over the heat conduction member, is tensioned, increasing the load applied to the rotating fixing belt.

When grease is applied between the fixing belt and the pipe-shaped metal heat conduction member, viscous resistance of the grease increases frictional resistance between the fixing belt and the heat conduction member. Even when a sliding coating is applied to an outer circumferential surface of the heat conduction member, viscous resistance between the grease and an inner circumferential surface of the fixing belt does not decrease.

To address this problem, in the fixing device 20 according to this exemplary embodiment, the plurality of convex portions 50 is provided on an outer circumferential surface of the heat conduction member 22 to decrease the area of contact between the inner circumferential surface of the fixing belt 21 and the outer circumferential surface of the heat conduction member 22 so as to decrease frictional resistance between the rotating fixing belt 21 and the stationary heat conduction member 22.

Figure 8:
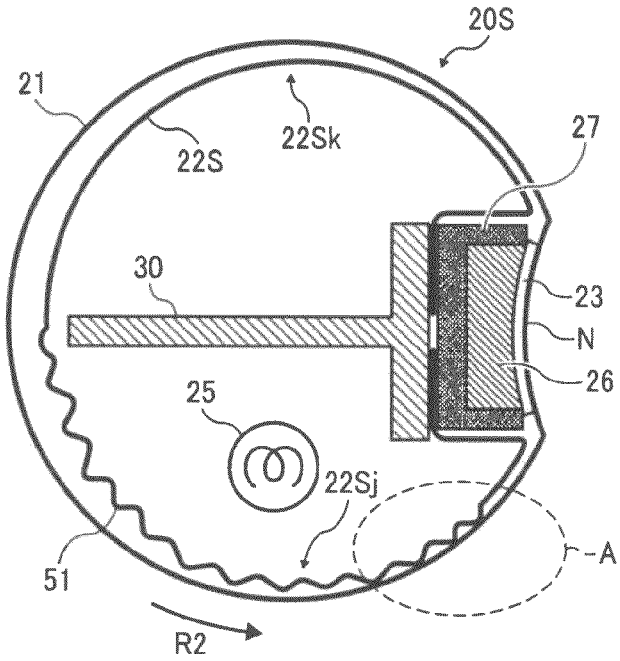
FIG. 8 is a sectional view of a fixing device according to another exemplary embodiment of the present invention.

FIG. 8 is a sectional view of a fixing device 20S according to another exemplary embodiment. As illustrated in FIG. 8, the fixing device 20S includes a heat conduction member 22S including convex portions 51, which replaces the heat conduction member 22 depicted in FIG. 6. The heat conduction member 22S includes an upstream portion 22Sj and a downstream portion 22Sk. The other elements of the fixing device 20S are equivalent to the elements of the fixing device 20 depicted in FIG. 6. The plurality of convex portions 51 is provided in the upstream portion 22Sj of the heat conduction member 22S, provided upstream from the fixing nip N in the rotation direction R2 of the fixing belt 21. Importantly, the plurality of convex portions 51 has a uniform height.

An experiment performed with the fixing device 20S has revealed that the convex portions 51 having the uniform height decrease the load applied to the rotating fixing belt 21.

Another experiment performed with the fixing device 20 depicted in FIG. 6 including the convex portions 50 having non-uniform heights decreasing toward the fixing nip N has revealed that the convex portions 50 point-contact the inner circumferential surface of the fixing belt 21 substantially uniformly, decreasing the load applied to the rotating fixing belt 21 and providing a shortened warm-up time equivalent to a warm-up time provided by a heat conduction member that does not include the convex portions 50. Namely, heat conduction from the convex portions 50 point-contacting the fixing belt 21 to the fixing belt 21 and the convex shape of the convex portions 50 facilitate convection between the fixing belt 21 and the heat conduction member 22.

In the fixing device 20S depicted in FIG. 8 including the convex portions 51 having the uniform height, the convex portions 51 provided closer to the fixing nip N contact the inner circumferential surface of the fixing belt 21 in a region A, on the approach to the fixing nip N. By contrast, in regions other than the region A, the summits of the convex portions 51 are separated from the inner circumferential surface of the fixing belt 21, decreasing the load applied to the rotating fixing belt 21.

However, in the fixing device 20S, the convex portions 51 separated from the fixing belt 21 do not contact the inner circumferential surface of the fixing belt 21, and therefore heat is not transmitted from the heat conduction member 22S to the fixing belt 21 easily.

Figure 9:
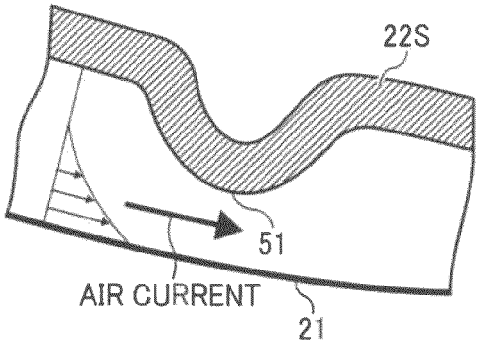
FIG. 9 is an enlarged sectional view of a heat conduction member included in the fixing device shown in FIG. 8.

For example, FIG. 9 is an enlarged sectional view of the heat conduction member 22S of the fixing device 20S. As illustrated in FIG. 9, air currents that flow between the rotating fixing belt 21 and the heat conduction member 22S move at greater speed as the air currents flow at a position closer to the inner circumferential surface of the fixing belt 21, and most of the air currents slip through between the summit of the convex portion 51 and the inner circumferential surface of the fixing belt 21, decreasing heating efficiency for heating the fixing belt 21 slightly.

Figure 10:
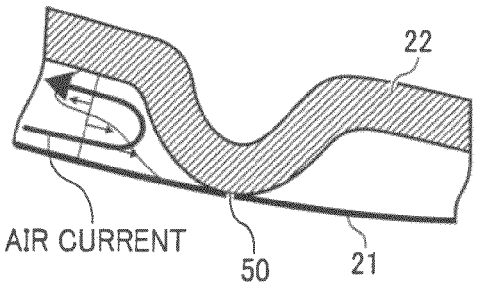
FIG. 10 is an enlarged sectional view of a heat conduction member included in the fixing device shown in FIG. 6.

By contrast, FIG. 10 is an enlarged sectional view of the heat conduction member 22 of the fixing device 20. As illustrated in FIG. 10, while the fixing belt 21 rotates, air currents that flow between the fixing belt 21 and the heat conduction member 22 contact the convex portion 50, generating convection. The convection moves heat from the heat conduction member 22 to the fixing belt 21, improving heating efficiency for heating the fixing belt 21. This is the advantage of employing the convex portions 50 the height h of which decreases as the convex portions 50 approach the fixing nip N in the rotation direction R2 of the fixing belt 21.

Thus, to sum up, as illustrated in FIG. 6, in the fixing device 20 in cross-section along the diameter of the heat conduction member 22, the plurality of convex portions 50 is provided in the upstream portion 22*j*, that is, the lower portion, of the heat conduction member 22, provided upstream from the fixing nip N in the rotation direction R2 of the fixing belt 21. The plurality of convex portions 50 provided in the upstream portion 22*j* of the heat conduction member 22, at which the fixing belt 21 is tensioned by the rotating pressing roller 31 depicted in FIG. 4, decreases frictional resistance between the heat conduction member 22 and the fixing belt 21 sliding over the heat conduction member 22 effectively.

Figure 11:
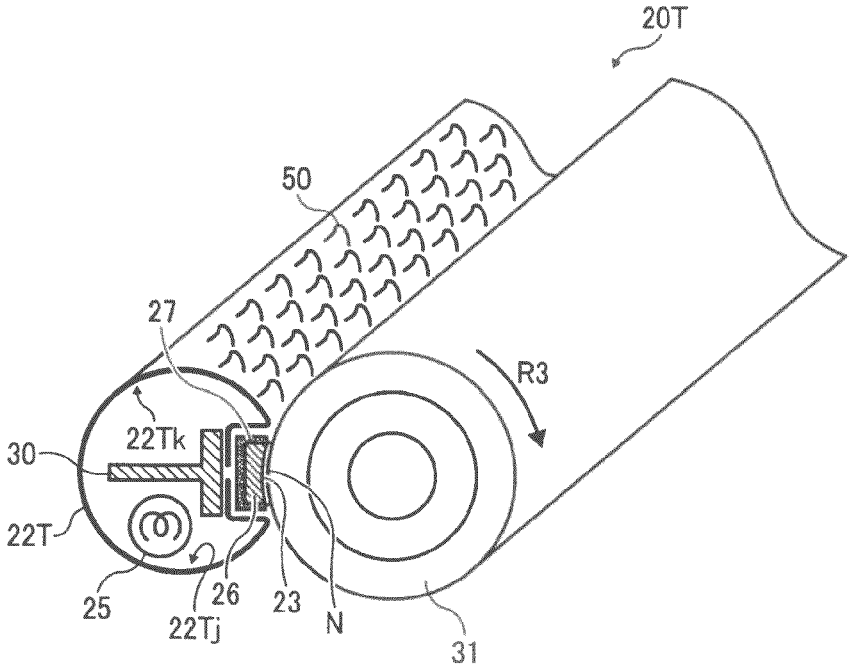
FIG. 11 is a perspective view of a comparative fixing device.

FIG. 11 is a perspective view of a comparative fixing device 20T. As illustrated in FIG. 11, the fixing device 20T includes a heat conduction member 22T replacing the heat conduction member 22 depicted in FIG. 6. The heat conduction member 22T includes an upstream portion 22Tj and a downstream portion 22Tk. The other elements of the fixing device 20T are equivalent to the elements of the fixing device 20. In FIG. 11, the fixing belt 21 is omitted for clarity.

In the fixing device 20T, the convex portions 50 are also provided in the downstream portion 22Tk of the heat conduction member 22T provided downstream from the fixing nip N in the rotation direction of the fixing belt 21, at which the fixing belt 21 tends to go slack. In other words, the convex portions 50 are provided on substantially the entire outer circumferential surface of the heat conduction member 22T, that is, both in the upstream portion 22Tj and the downstream portion 22Tk of the heat conduction member 22T.

With the above-described structure, however, the summits of the convex portions 50 contact substantially the entire inner circumferential surface of the fixing belt 21. Accordingly, when the heat conduction member 22T is assembled into the fixing device 20T, the heat conduction member 22T may not be inserted into the fixing belt 21 easily.

Further, in the structure depicted in FIG. 4 in which the fixing belt 21 is disposed adjacent to the pressing roller 31 in a horizontal direction to form the fixing nip N in a vertical direction, when the fixing belt 21 rotates, a lower portion of the fixing belt 21, that is, an upstream portion of the fixing belt 21 provided upstream from the fixing nip N in the rotation direction R2 of the fixing belt 21, contacts the heat conduction member 22 in such a manner that the lower portion of the fixing belt 21 is wound around the heat conduction member 22. By contrast, when the fixing belt 21 does not rotate, weight of the fixing belt 21 causes an upper portion of the fixing belt 21, that is, a downstream portion of the fixing belt 21 provided downstream from the fixing nip N in the rotation direction R2 of the fixing belt 21, to contact the heat conduction member 22. The implications of this fact are that when the fixing belt 21 rotates, the convex portions 50 need not be provided in the downstream portion 22*k* of the heat conduction member 22 provided downstream from the fixing nip N in the rotation direction R2 of the fixing belt 21, at which the fixing belt 21 tends to go slack, as long as the convex portions 50 are provided in the upstream portion 22*j* of the heat conduction member 22 provided upstream from the fixing nip N in the rotation direction R2 of the fixing belt 21, at which the fixing belt 21 is tensioned.

Thus, in a standby mode of operation in which the heat conduction member 22 heats the fixing belt 21 while the fixing belt 21 remains still and does not rotate, the heat conduction member 22 contacts the inner circumferential surface of the fixing belt 21 over a greater area. Therefore, the convex portions 50 are not necessary in the downstream portion 22*k*, that is, the upper portion, of the heat conduction member 22 provided downstream from the fixing nip N in the rotation direction R2 of the fixing belt 21 in view of heating efficiency for heating the fixing belt 21.

Figure 12:
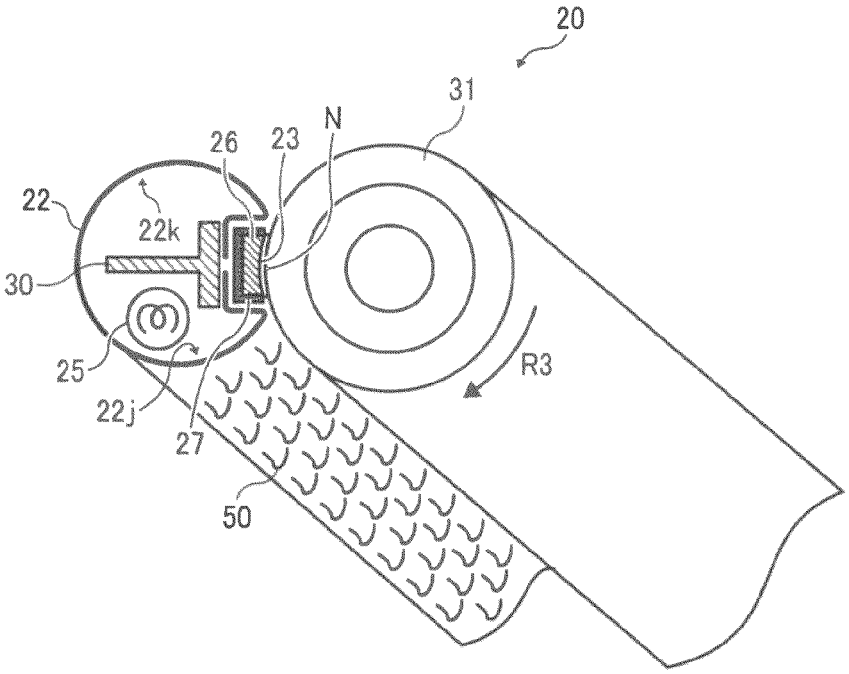
FIG. 12 is a perspective view of the fixing device shown in FIG. 5.

FIG. 12 is a perspective view of the fixing device 20. In FIG. 12, the fixing belt 21 is omitted for clarity. As illustrated in FIG. 12, due to the above-described reasons, the convex portions 50 may be preferably provided in the upstream portion 22*j* of the heat conduction member 22 provided upstream from the fixing nip N in the rotation direction of the fixing belt 21, facing a portion of the fixing belt 21 tensioned by the rotating pressing roller 31, that is, in substantially the lower half portion of a circumference of the heat conduction member 22, so as to decrease the load applied to the rotating fixing belt 21 and improve heating efficiency for preheating the fixing belt 21 in the standby mode, in which the fixing belt 21 does not rotate.

As described above, in the fixing device 20 depicted in FIG. 6, the plurality of convex portions 50 is provided on the heat conduction member 22 to decrease the area of contact over which the heat conduction member 22 contacts the fixing belt 21, thus decreasing sliding resistance between the heat conduction member 22 and the fixing belt 21 sliding over the heat conduction member 22. Similarly, in the fixing device 20S depicted in FIG. 8, the plurality of convex portions 51 is provided on the heat conduction member 22S to decrease the area of contact over which the heat conduction member 22S contacts the fixing belt 21, thus decreasing sliding resistance between the heat conduction member 22S and the fixing belt 21 sliding over the heat conduction member 22S.

As previously described, in the fixing device 20 depicted in FIG. 6, as a clearance between the heat conduction member 22 and the fixing belt 21 narrows, that is, as the convex portions 50 are disposed closer to the fixing nip N, the height h of the convex portions 50 decreases. Accordingly, the summits of the convex portions 50 contact the inner circumferential surface of the fixing belt 21 uniformly, preventing only partial contact of the convex portions 50 with the fixing belt 21, which is unsatisfactory. Further, heat is transmitted from the heat conduction member 22 to the fixing belt 21 by the contact of the summits of the convex portions 50 with the fixing belt 21 and convection in the clearance between the heat conduction member 22 and the fixing belt 21, which is accelerated by the convex portions 50 when the fixing belt 21 rotates, resulting in improved heating efficiency for heating the fixing belt 21.

Figure 13:
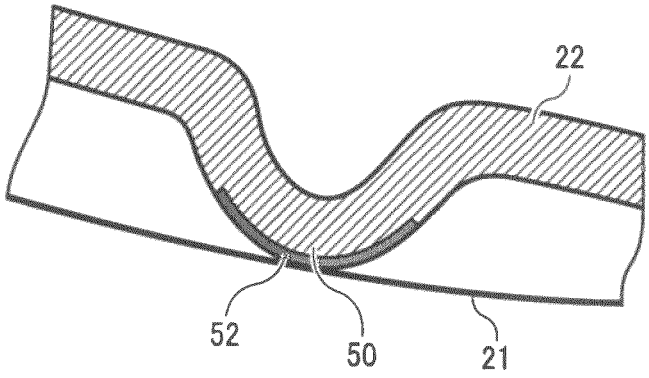
FIG. 13 is an enlarged sectional view of the heat conduction member shown in FIG. 10 and a low-friction coating layer provided on the heat conduction member.

It is known that the fixing belt 21 sliding over the convex portions 50 abrades the summits of the convex portions 50 over time. To address this problem, a low-friction coating layer 52 may be provided on the convex portion 50. FIG. 13 is an enlarged sectional view showing the heat conduction member 22 and the low-friction coating layer 52 provided on the heat conduction member 22. As illustrated in FIG. 13, the low-friction coating layer 52 is provided on a slide-contact portion of the convex portion 50 over which the fixing belt 21 slides to provide lubrication and prevent abrasion of the convex portion 50 by the sliding fixing belt 21.

When the low-friction coating layer 52 covers the entire surface of the heat conduction member 22, the low-friction coating layer 52 may itself become a thermal resistance. To address this problem, according to this exemplary embodiment, the low-friction coating layer 52 is provided only on the convex portion 50 of the heat conduction member 22. The fixing belt 21 slides over the summit of the convex portion 50. Accordingly, the low-friction coating layer 52 provided on the convex portion 50 can prevent abrasion of the heat conduction member 22 by the sliding fixing belt 21. The bottom of the convex portion 50 is not provided with the low-friction coating layer 52, and therefore is heated effectively, improving heat transmission efficiency of transmitting heat from the heat conduction member 22 to the fixing belt 21 by convection.

The low-friction coating layer 52 may be coated on the convex portion 50 by masking a portion of the heat conduction member 22 other than the convex portion 50.

According to this exemplary embodiment, the pipe-shaped metal heat conduction member 22 includes stainless steel, and the low-friction coating layer 52 is coated on the convex portion 50 only as illustrated in FIG. 13. The low-friction coating layer 52 may include fluorocarbon resin as a principal ingredient in view of heat resistance and sliding property, and may have a thickness in a range of from 5 μm to 30 μm.

Various additives were tested to supplement heat conductivity of the low-friction coating layer 52. However, the test has revealed that a foreign substance contained in the low-friction coating layer 52 degrades durability of the low-friction coating layer 52 against sliding of the fixing belt 21.

Figure 14:
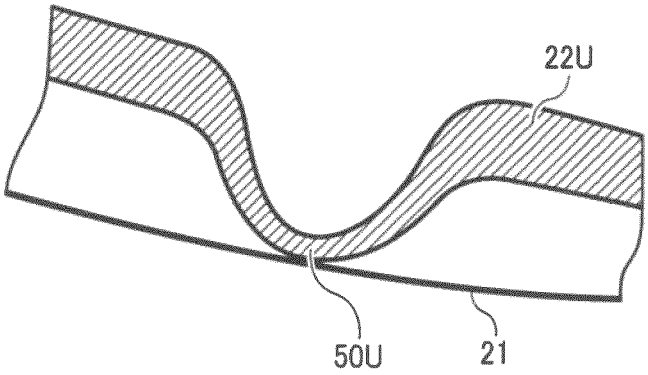
FIG. 14 is an enlarged sectional view of a heat conduction member according to yet another exemplary embodiment of the present invention.

FIG. 14 is an enlarged sectional view of a heat conduction member 22U including a thin convex portion 50U of reduced thickness, as a variation. The convex portion 50U contacts the fixing belt 21 to transmit heat to the fixing belt 21. The heat conduction member 22U is heated by the halogen heater 25 depicted in FIG. 6 provided inside the heat conduction member 22U. Accordingly, in order to improve heating efficiency by facilitating transmission of heat received from the halogen heater 25 to the summit of the convex portion 50U, a thickness of the convex portion 50U is reduced to less than a thickness of a portion of the heat conduction member 22U other than the convex portion 50U as illustrated in FIG. 14 to decrease heat resistance of the convex portion 50U.

The summit of the convex portion 50U is the thinnest part thereof, having a thickness of about 40 percent to about 80 percent of a thickness of a portion of the heat conduction member 22U other than the convex portion 50U. If the convex portion 50U is excessively thin, that is, less than about 40 percent, simple production errors may hole the convex portion 50U. By contrast, if the convex portion 50U is excessively thick, that is, greater than about 80 percent, heat resistance of the convex portion 50U may not decrease sufficiently.

The inner circumferential surface of the fixing belt 21 slides over the heat conduction member 22U at the summit of the convex portion 50U. Accordingly, a lubricant (e.g., grease) is applied between the fixing belt 21 and the heat conduction member 22U to reduce sliding resistance between the fixing belt 21 and the heat conduction member 22U. However, the lubricant may be accumulated on a portion of the heat conduction member 22U other than the summit of the convex portion 50U, degrading effects of the lubricant.

Figure 15:
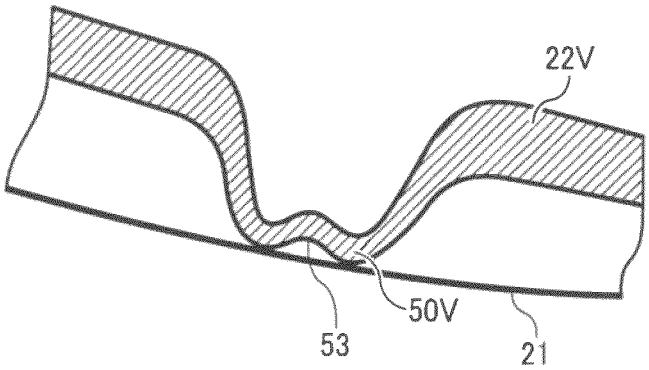
FIG. 15 is an enlarged sectional view of a heat conduction member according to yet another exemplary embodiment of the present invention.

FIG. 15 is an enlarged sectional view of a heat conduction member 22V including a convex portion 50V including a lubricant sump 53, as a further variation. The concave-shaped lubricant sump 53 is provided on the summit of the convex portion 50V facing the fixing belt 21 to receive the lubricant. A depth of the lubricant sump 53 is smaller than half of the height h of the convex portion 50V. The lubricant sump 53 is provided on each of the plurality of convex portions 50V.

The thin convex portion 50U and the concave-shaped lubricant sump 53 may be manufactured by adjusting a clearance between a punch and a die for pressing when the heat conduction member 22U or 22V and the convex portion 50U or 50V are molded.

Figure 16:
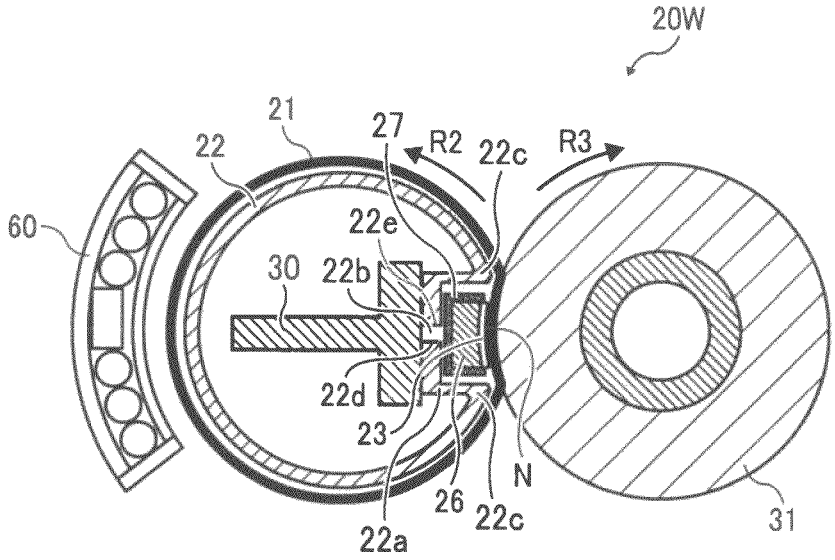
FIG. 16 is a sectional view of a fixing device according to yet another exemplary embodiment of the present invention.

FIG. 16 is a sectional view of a fixing device 20W according to yet another exemplary embodiment. As illustrated in FIG. 16, the fixing device 20W includes an induction heater 60. The heat conduction member 22 further includes an upstream edge 22*d* and a downstream edge 22*e*. The induction heater 60 replaces the halogen heater 25 depicted in FIG. 4. The other elements of the fixing device 20W are equivalent to the elements of the fixing device 20 depicted in FIG. 4.

The fixing device 20W includes the induction heater 60 instead of the halogen heater 25 depicted in FIG. 4. The induction heater 60 is provided outside the loop formed by the fixing belt 21 to face the outer circumferential surface of the fixing belt 21, and serves as a heater for heating the fixing belt 21 by using electromagnetic induction of induction heating (IH).

The induction heater 60 includes an exciting coil, a core, and a coil guide. The exciting coil includes litz wires formed of bundled thin wires and extended in a width direction, that is, an axial direction, of the fixing belt 21 to cover a part of the fixing belt 21. The coil guide includes heat-resistant resin and holds the exciting coil and the core. The core is a semi-cylindrical member formed of a ferromagnet (e.g., ferrite) having relative magnetic permeability in a range of from about 1,000 to about 3,000. The core includes a center core and a side core to generate magnetic fluxes toward the heat conduction member 22 effectively. The core is disposed opposite the exciting coil extending in the width direction of the fixing belt 21.

The following describes operation of the fixing device 20W including the induction heater 60 having the above-described structure.

When the fixing belt 21 rotates in the rotation direction R2, the induction heater 60 heats the fixing belt 21 at a position at which the fixing belt 21 faces the induction heater 60. Specifically, a high-frequency alternating current is applied to the exciting coil to generate magnetic lines of force around the heat conduction member 22 in such a manner that the magnetic lines of force are alternately switched back and forth. Accordingly, an eddy current generates on the surface of the heat conduction member 22, and electric resistance of the heat conduction member 22 generates Joule heat. The Joule heat heats the heat conduction member 22 by electromagnetic induction, and the heated heat conduction member 22 heats the fixing belt 21.

In order to heat the heat conduction member 22 effectively by electromagnetic induction, the induction heater 60 may face the heat conduction member 22 in an entire circumferential direction of the heat conduction member 22. The heat conduction member 22 may include nickel, stainless steel, iron, copper, cobalt, chrome, aluminum, gold, platinum, silver, tin, palladium, an alloy of a plurality of those metals, and/or the like.

The heat conduction member 22 contacts or faces the inner circumferential surface of the fixing belt 21 to support or hold the fixing belt 21 to heat the fixing belt 21. The heat conduction member 22 may be manufactured by bending a thin sheet metal into a pipe shape at relatively reduced manufacturing costs, improving heating efficiency for heating the fixing belt 21, shortening a warm-up time or a first print time, and suppressing faulty fixing which may occur when the fixing device 20W is driven at high speed.

Figure 17:
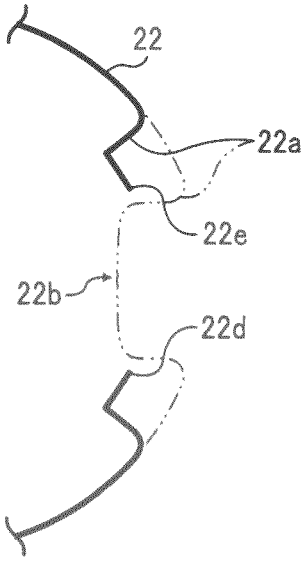
FIG. 17 is a partially enlarged view of a heat conduction member included in the fixing device shown in FIG. 16.

FIG. 17 is a partially enlarged view of the heat conduction member 22. If the thin sheet metal is bent into the pipe shape in such a manner that the upstream edge 22*d* of the heat conduction member 22 provided upstream from the fixing nip N in the rotation direction R2 of the fixing belt 21 (depicted in FIG. 16) is separated from the downstream edge 22*e* of the heat conduction member 22 provided downstream from the fixing nip N, the inherent spring-back of the thin sheet metal may enlarge the opening 22*b* between the upstream edge 22*d* and the downstream edge 22*e* as illustrated in FIG. 17. Accordingly, the heat conduction member 22 may not contact or press against the fixing belt 21 with uniform pressure.

To address this problem, at least a part of the upstream edge 22*d* in a width direction, that is, an axial direction, of the heat conduction member 22 may be combined with the downstream edge 22*e* to prevent the spring-back of the heat conduction member 22 from enlarging the opening 22*b* between the upstream edge 22*d* and the downstream edge 22*e*. For example, the upstream edge 22*d* may be combined with the downstream edge 22*e* by welding.

In the heat conduction member 22, the corner portions 22*c* (depicted in FIG. 16) are provided in the concave portion 22*a* housing the nip formation member 26. If the corner portions 22*c* and the vicinity thereof press against the pressing roller 31 via the fixing belt 21, pressure applied by the pressing roller 31 may deform the heat conduction member 22. Accordingly, the heat conduction member 22 may not contact or press against the fixing belt 21 with uniform pressure.

To address this problem, the heat conduction member 22 including the corner portions 22*c* does not press against the pressing roller 31 via the fixing belt 21. For example, the corner portions 22*c* are provided at positions separated from the fixing nip N so that the corner portions 22*c* are separated from the pressing roller 31.

Conventional fixing devices have the following three problems to be solved.

Firstly, when the fixing belt 21 rotates in accordance with rotation of the pressing roller 31, substantial load applied to the rotating fixing belt 21 may apply a substantial shearing force to an outer circumferential surface of the pressing roller 31 continuously, resulting in wear of the pressing roller 31 over time and slippage of the fixing belt 21.

Secondly, if a substantial gap is provided between the fixing belt 21 and a pipe-shaped metal member for heating the fixing belt 21 to decrease the sliding load of the fixing belt 21 sliding over the pipe-shaped metal member, heat resistance between the pipe-shaped metal member and the fixing belt 21 may increase, disturbing temperature increase of the fixing belt 21 and therefore lengthening a warm-up time of an image forming apparatus installed with the fixing device.

Thirdly, if a sliding coating layer is provided on an entire outer circumferential surface of the pipe-shaped metal member to reduce sliding resistance of the fixing belt 21 sliding over the pipe-shaped metal member, the sliding coating layer may increase manufacturing costs and act as a heat resistance, disturbing temperature increase of the fixing belt 21.

To address the above-described problems, the fixing device 20, 20S, or 20W depicted in FIG. 6, 8, or 16, respectively, includes the heat conduction member 22, 22S, 22U, or 22V to provide the following effects.

In a fixing device (e.g., the fixing device 20, 20S, or 20W depicted in FIG. 6, 8, or 16, respectively) for fixing a toner image on a recording medium, a flexible endless fixing member (e.g., the fixing belt 21) rotates in a predetermined direction of rotation, and is formed into a loop. A nip formation member (e.g., the nip formation member 26) is provided inside the loop formed by the fixing member. A pressing member (e.g., the pressing roller 31) is disposed opposite the nip formation member and outside the loop formed by the fixing member, and is pressed against the nip formation member via the fixing member to form a nip (e.g., the fixing nip N) between the fixing member and the pressing member through which the recording medium bearing the toner image passes. The fixing member and the pressing member rotate and convey the recording medium bearing the toner image through the nip. A non-rotating heat conduction member (e.g., the heat conduction member 22, 22S, 22U, or 22V depicted in FIG. 6, 8, 14, or 15, respectively) is disposed within the loop formed by the fixing member and faces an inner circumferential surface of the fixing member to guide the fixing member sliding over the heat conduction member as the fixing member rotates and to transmit heat to the fixing member. The heat conduction member includes a plurality of convex portions (e.g., the convex portions 50 or 51 depicted in FIG. 6 or 8, respectively) provided on an outer circumferential surface of the heat conduction member and contacting the inner circumferential surface of the fixing member.

With this configuration, the rotating fixing member slides over the plurality of convex portions of the heat conduction member with decreased frictional sliding resistance between the fixing member and the heat conduction member. Thus, the heat conduction member heats the fixing member properly without decreasing a driving force of the fixing member.

A height of the plurality of convex portions of the heat conduction member decreases toward the nip in the direction of rotation of the fixing member.

With this configuration, frictional sliding resistance between the heat conduction member and the fixing member sliding over the heat conduction member is decreased. Further, heat is transmitted from the heat conduction member to the fixing member effectively, shortening a warm-up time of the fixing device.

The rotating pressing member applies tension to the rotating fixing member at a tension reception portion, facing the upstream portion 22*j* or 22Sj depicted in FIG. 6 or 8, respectively, of the fixing member to rotate the fixing member in accordance with rotation of the pressing member. The plurality of convex portions of the heat conduction member contacts the tension reception portion of the fixing member.

With this configuration, the rotating fixing member slides over the upstream portion of the heat conduction member provided upstream from the fixing nip in the rotation direction of the fixing member with a greater sliding force, at which the fixing member is tensioned by the rotating pressing member. Accordingly, the convex portions of the heat conduction member reduce frictional sliding resistance between the heat conduction member and the fixing member sliding over the heat conduction member without disturbing temperature increase of the fixing member. Further, when the fixing member is stopped, weight of the fixing member causes the inner circumferential surface of the fixing member to contact a downstream portion (e.g., the downstream portion 22*k* or 22Sk depicted in FIG. 6 or 8, respectively) of the heat conduction member provided downstream from the fixing nip in the rotation direction of the fixing member at which the rotating fixing member goes slack. The downstream portion of the heat conduction member on which the convex portions are not provided contacts the fixing member at a greater area compared to the upstream portion of the heat conduction member, improving heat transmission from the heat conduction member to the fixing member when the heat conduction member heats the stopped fixing member. The stopped fixing member is not loaded with frictional resistance that is applied to the rotating fixing member. Moreover, convection generated by the convex portions provided on the upstream portion does not generate on the downstream portion.

The plurality of convex portions is provided in an upstream portion (e.g., the upstream portion 22*j* or 22Sj depicted in FIG. 6 or 8, respectively) of the heat conduction member upstream from the nip in the direction of rotation of the fixing member.

With this configuration, reduced load is applied to the rotating fixing member. Simultaneously, the stopped fixing member is preheated effectively in a standby mode.

A low-friction coating layer (e.g., the low-friction coating layer 52 depicted in FIG. 13) is provided on each of the plurality of convex portions of the heat conduction member.

With this configuration, the sliding load applied to the fixing member sliding over the summits of the convex portions is decreased, and abrasion of the convex portions by the sliding fixing member is reduced. On the other hand, the low-friction coating layer is not provided on a surface portion of the heat conduction member other than the convex portion, preventing heat resistance generated by the low-friction coating layer, and therefore improving heat transmission efficiency for transmitting heat from the heat conduction member to the fixing member.

The plurality of convex portions of the heat conduction member has a thickness less than a thickness of a portion of the heat conduction member other than the plurality of convex portions.

The fixing member sliding over the summit of the convex portion of the heat conduction member draws heat from the convex portion continuously. To address this problem, the thin summit of the convex portion of the heat conduction member decreases heat resistance applied to heat transmitted from the inner circumferential surface of the heat conduction member heated by a heater provided inside the heat conduction member to the outer circumferential surface of the heat conduction member. In other words, the thin summit of the convex portion of the heat conduction member does not degrade heating performance of the heat conduction member for heating the fixing member.

A lubricant sump (e.g., the lubricant sump 53 depicted in FIG. 15) is provided on each of the plurality of convex portions of the heat conduction member to receive a lubricant applied between the inner circumferential surface of the fixing member and the outer circumferential surface of the heat conduction member.

With this configuration, the fixing member slides over the convex portion of the heat conduction member smoothly. The fixing member sliding over the convex portion of the heat conduction member abrades the convex portion slightly over time. To address this problem, the lubricant is supplied from the lubricant sump to the convex portion to improve sliding performance of the fixing member.

The heat conduction member includes a metal pipe member.

With this configuration, the metal pipe member of the heat conduction member supports the fixing member stably with improved durability, and transmits heat to the fixing member effectively.

A heater is provided inside the heat conduction member to heat the fixing member via the heat conduction member.

With this configuration, the heater provided inside the heat conduction member heats the heat conduction member, improving heating efficiency for heating the heat conduction member.

The heater includes a halogen heater (e.g., the halogen heater 25 depicted in FIG. 6 or 8).

Alternatively, a heater may be provided outside the fixing member to heat the fixing member via the heat conduction member.

With this configuration, the inside structure of the fixing member and the placement of the heater are simplified.

The heater may include an induction heater (e.g., the induction heater 60 depicted in FIG. 16) including an exciting coil.

An image forming apparatus (e.g., the image forming apparatus 1 depicted in FIG. 3) includes an image forming device (e.g., the image forming devices 4Y, 4M, 4C, and 4K depicted in FIG. 3) that forms a toner image on a recording medium and the fixing device having the above-described structure and configuration to fix the toner image on the recording medium.

With this configuration, the fixing device provides improved fixing performance stably to form a high-quality toner image effectively.

In the fixing devices 20, 20S, and 20W according to the above-described exemplary embodiments, the pressing roller 31 is used as a pressing member. Alternatively, a pressing belt or a pressing pad may be used as a pressing member to provide effects equivalent to the effects provided by the pressing roller 31.

Further, the fixing belt 21, which may have a multi-layer structure, is used as a fixing member. Alternatively, an endless fixing film made of polyimide resin, polyamide resin, fluorocarbon resin, or thin sheet metal may be used as a fixing member to provide effects equivalent to the effects provided by the fixing belt 21.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, comprising:

a flexible endless fixing member to rotate in a predetermined direction of rotation, formed into a loop;

a nip formation member provided inside the loop formed by the fixing member;

a pressing member disposed opposite the nip formation member and outside the loop formed by the fixing member, pressed against the nip formation member via the fixing member to form a nip between the fixing member and the pressing member through which the recording medium bearing the toner image passes;

the fixing member and the pressing member rotating and conveying the recording medium bearing the toner image through the nip; and a non-rotating heat conduction member disposed within the loop formed by the fixing member and facing an inner circumferential surface of the fixing member to guide the fixing member sliding over the heat conduction member as the fixing member rotates and to transmit heat to the fixing member, comprising a plurality of convex portions provided on an outer circumferential surface of the heat conduction member and contacting the inner circumferential surface of the fixing member, wherein a height of the plurality of convex portions of the heat conduction member decreases toward the nip in the direction of rotation of the fixing member.

2. The fixing device according to claim 1, wherein the rotating pressing member applies tension to the rotating fixing member at a tension reception portion of the fixing member to rotate the fixing member in accordance with rotation of the pressing member, and wherein the plurality of convex portions of the heat conduction member contacts the tension reception portion of the fixing member.

3. The fixing device according to claim 1, further comprising a low-friction coating layer provided on each of the plurality of convex portions of the heat conduction member.

4. The fixing device according to claim 1, wherein the plurality of convex portions of the heat conduction member has a thickness less than a thickness of a portion of the heat conduction member other than the plurality of convex portions.

5. The fixing device according to claim 1, further comprising a lubricant sump provided on each of the plurality of convex portions of the heat conduction member to receive a lubricant applied between the inner circumferential surface of the fixing member and the outer circumferential surface of the heat conduction member.

6. The fixing device according to claim 1, further comprising a heater provided inside the heat conduction member to heat the fixing member via the heat conduction member.

7. The fixing device according to claim 6, wherein the heater comprises a halogen heater.

8. An image forming apparatus comprising:

an image forming device to form a toner image on a recording medium; and the fixing device according to claim 1.

9. The fixing device according to claim 1, wherein the plurality of convex portions is provided in an upstream portion of the heat conduction member upstream from the nip in the direction of rotation of the fixing member.

10. The fixing device according to claim 1, wherein the heat conduction member comprises a metal pipe member.

11. The fixing device according to claim 1, further comprising a heater provided outside the fixing member to heat the fixing member via the heat conduction member.

12. The fixing device according to claim 11, wherein the heater comprises an induction heater including an exciting coil.

13. A fixing device for fixing a toner image on a recording medium, comprising:

a flexible endless fixing member to rotate in a predetermined direction of rotation, formed into a loop;

a nip formation member provided inside the loop formed by the fixing member;

a pressing member disposed opposite the nip formation member and outside the loop formed by the fixing member, pressed against the nip formation member via the fixing member to form a nip between the fixing member and the pressing member through which the recording medium bearing the toner image passes;

the fixing member and the pressing member rotating and conveying the recording medium bearing the toner image through the nip; and a non-rotating heat conduction member disposed within the loop formed by the fixing member and facing an inner circumferential surface of the fixing member to guide the fixing member sliding over the heat conduction member as the fixing member rotates and to transmit heat to the fixing member, comprising a plurality of convex portions provided on an outer circumferential surface of the heat conduction member and contacting the inner circumferential surface of the fixing member, wherein the plurality of convex portions is provided in an upstream portion of the heat conduction member upstream from the nip in the direction of rotation of the fixing member.

14. The fixing device according to claim 13, wherein the rotating pressing member applies tension to the rotating fixing member at a tension reception portion of the fixing member to rotate the fixing member in accordance with rotation of the pressing member, and wherein the plurality of convex portions of the heat conduction member contacts the tension reception portion of the fixing member.

15. The fixing device according to claim 13, further comprising a low-friction coating layer provided on each of the plurality of convex portions of the heat conduction member.

16. The fixing device according to claim 13, wherein the plurality of convex portions of the heat conduction member has a thickness less than a thickness of a portion of the heat conduction member other than the plurality of convex portions.

17. The fixing device according to claim 13, further comprising a lubricant sump provided on each of the plurality of convex portions of the heat conduction member to receive a lubricant applied between the inner circumferential surface of the fixing member and the outer circumferential surface of the heat conduction member.

18. The fixing device according to claim 13, wherein the heat conduction member comprises a metal pipe member.

19. The fixing device according to claim 13, further comprising a heater provided inside the heat conduction member to heat the fixing member via the heat conduction member.

20. The fixing device according to claim 19, wherein the heater comprises a halogen heater.

21. The fixing device according to claim 13, further comprising a heater provided outside the fixing member to heat the fixing member via the heat conduction member.

22. The fixing device according to claim 21, wherein the heater comprises an induction heater including an exciting coil.

23. An image forming apparatus comprising:

an image forming device to form a toner image on a recording medium; and the fixing device according to claim 13.

24. A fixing device for fixing a toner image on a recording medium, comprising:

a flexible endless fixing member to rotate in a predetermined direction of rotation, formed into a loop;

a nip formation member provided inside the loop formed by the fixing member;

a pressing member disposed opposite the nip formation member and outside the loop formed by the fixing member, pressed against the nip formation member via the fixing member to form a nip between the fixing member and the pressing member through which the recording medium bearing the toner image passes;

the fixing member and the pressing member rotating and conveying the recording medium bearing the toner image through the nip; and a non-rotating heat conduction member disposed within the loop formed by the fixing member and facing an inner circumferential surface of the fixing member to guide the fixing member sliding over the heat conduction member as the fixing member rotates and to transmit heat to the fixing member, comprising a plurality of convex portions provided on an outer circumferential surface of the heat conduction member and contacting the inner circumferential surface of the fixing member, wherein the heat conduction member comprises a metal pipe member.

25. The fixing device according to claim 24, wherein the rotating pressing member applies tension to the rotating fixing member at a tension reception portion of the fixing member to rotate the fixing member in accordance with rotation of the pressing member, and wherein the plurality of convex portions of the heat conduction member contacts the tension reception portion of the fixing member.

26. The fixing device according to claim 24, further comprising a low-friction coating layer provided on each of the plurality of convex portions of the heat conduction member.

27. The fixing device according to claim 24, wherein the plurality of convex portions of the heat conduction member has a thickness less than a thickness of a portion of the heat conduction member other than the plurality of convex portions.

28. The fixing device according to claim 24, further comprising a lubricant sump provided on each of the plurality of convex portions of the heat conduction member to receive a lubricant applied between the inner circumferential surface of the fixing member and the outer circumferential surface of the heat conduction member.

29. The fixing device according to claim 24, further comprising a heater provided inside the heat conduction member to heat the fixing member via the heat conduction member.

30. The fixing device according to claim 29, wherein the heater comprises a halogen heater.

31. The fixing device according to claim 24, further comprising a heater provided outside the fixing member to heat the fixing member via the heat conduction member.

32. The fixing device according to claim 31, wherein the heater comprises an induction heater including an exciting coil.

33. An image forming apparatus comprising:

an image forming device to form a toner image on a recording medium; and the fixing device according to claim 24.

34. A fixing device for fixing a toner image on a recording medium, comprising:

a flexible endless fixing member to rotate in a predetermined direction of rotation, formed into a loop;

a nip formation member provided inside the loop formed by the fixing member;

a pressing member disposed opposite the nip formation member and outside the loop formed by the fixing member, pressed against the nip formation member via the fixing member to form a nip between the fixing member and the pressing member through which the recording medium bearing the toner image passes;

the fixing member and the pressing member rotating and conveying the recording medium bearing the toner image through the nip;

a non-rotating heat conduction member disposed within the loop formed by the fixing member and facing an inner circumferential surface of the fixing member to guide the fixing member sliding over the heat conduction member as the fixing member rotates and to transmit heat to the fixing member, comprising a plurality of convex portions provided on an outer circumferential surface of the heat conduction member and contacting the inner circumferential surface of the fixing member; and a heater provided outside the fixing member to heat the fixing member via the heat conduction member.

35. The fixing device according to claim 34, wherein the heater comprises an induction heater including an exciting coil.

36. The fixing device according to claim 34, wherein the rotating pressing member applies tension to the rotating fixing member at a tension reception portion of the fixing member to rotate the fixing member in accordance with rotation of the pressing member, and wherein the plurality of convex portions of the heat conduction member contacts the tension reception portion of the fixing member.

37. The fixing device according to claim 34, further comprising a low-friction coating layer provided on each of the plurality of convex portions of the heat conduction member.

38. The fixing device according to claim 34, wherein the plurality of convex portions of the heat conduction member has a thickness less than a thickness of a portion of the heat conduction member other than the plurality of convex portions.

39. The fixing device according to claim 34, further comprising a lubricant sump provided on each of the plurality of convex portions of the heat conduction member to receive a lubricant applied between the inner circumferential surface of the fixing member and the outer circumferential surface of the heat conduction member.

40. The fixing device according to claim 34, further comprising a heater provided inside the heat conduction member to heat the fixing member via the heat conduction member.

41. The fixing device according to claim 40, wherein the heater comprises a halogen heater.

42. An image forming apparatus comprising:

an image forming device to form a toner image on a recording medium; and the fixing device according to claim 34.

* * * * *